United States Patent [19]

Heinemann et al.

[11] Patent Number: 4,776,383

[45] Date of Patent: Oct. 11, 1988

[54] APPARATUS FOR PRODUCING STRIP-LIKE OR FOIL-LIKE PRODUCTS

[75] Inventors: Wilfried Heinemann, Richterswil; Thomas Gabriel, Riehen; Peter Reimann, Gelterkinden; Hans-Ulrich Künzi, Bottmingen; Hans-Joachim Güntherodt, Witterswil, all of Switzerland

[73] Assignee: Concast Standard AG, Zurich, Switzerland

[21] Appl. No.: 909,949

[22] Filed: Sep. 22, 1986

Related U.S. Application Data

[62] Division of Ser. No. 550,493, Nov. 10, 1983, Pat. No. 4,650,618.

[30] Foreign Application Priority Data

Nov. 12, 1982 [CH] Switzerland ..... 6621/82-4
Nov. 12, 1982 [CH] Switzerland ..... 6622/82-6

[51] Int. Cl.[4] ..... B22D 11/00

[52] U.S. Cl. ..... 164/423; 164/429; 264/171; 264/212; 425/133.5; 425/224

[58] Field of Search ..... 264/177.13, 177.14, 264/DIG. 81, 22, 25, 40.6, 85, 171, 212, 332, DIG. 25; 164/461, 479, 463, 418, 420, 429, 423; 428/641, 925 X, 939; 425/130, 131.1, 133.5, 224

[56] References Cited

U.S. PATENT DOCUMENTS 3,844,874 10/1974 Nalle, Jr. ..... 264/DIG. 81
4,142,571 3/1979 Narasimhan ..... 164/88
4,235,574 11/1980 Phillips ..... 264/177.13
4,257,830 3/1981 Tsuya et al. ..... 164/479
4,409,296 10/1983 Ward ..... 428/925

FOREIGN PATENT DOCUMENTS 0040069 11/1981 European Pat. Off. .
2083455 3/1982 United Kingdom .

*Primary Examiner*—Jay H. Woo
*Assistant Examiner*—C. Scott Bushey
*Attorney, Agent, or Firm*—Roylance, Abrams, Berdo & Goodman

[57] ABSTRACT

Juxtaposed nozzle openings apply the same or different melts to the surface of a moving cooler surface for producing thin metal strips or foils with a considerable width. The nozzle openings can be staggered in the direction of movement of the cooler surface and apply different materials to produce a metal strip with juxtaposed and sharply defined regions with different characteristics. Amorphous or mixed amorphous/crystalline, or solely crystalline material structures can also be produced. Alternatively, different cooling capacities on different cooler surface areas and different structuring of different cooler surface areas permit the melt to solidify on the cooler surface such that the strips or foils obtained have adjacent regions with different metallic and/or geometrical structures. By geometrical configuration of the cooler surface, foils with a structured surface or with shape-limited individual regions can be used for mass production of small parts from sheet or strip material.

18 Claims, 6 Drawing Sheets

FIG. 3
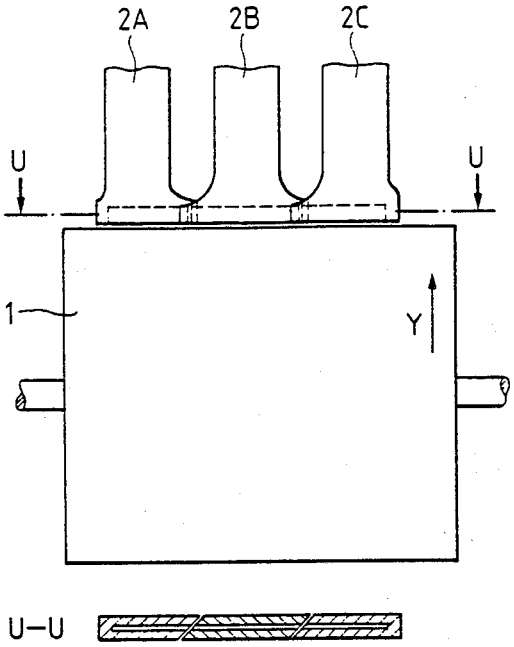
FIG. 3a
FIG. 4
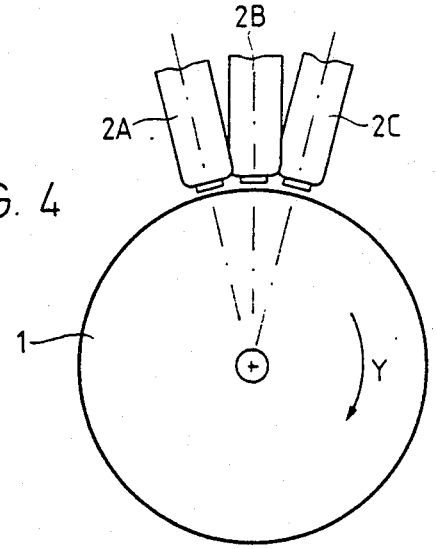
FIG. 5
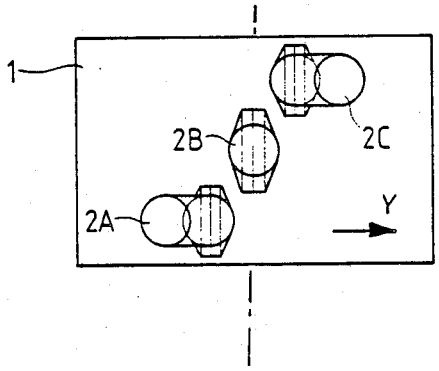

APPARATUS FOR PRODUCING STRIP-LIKE OR FOIL-LIKE PRODUCTS

This is a division of application Ser. No. 550,493 filed Nov. 10, 1983 and now U.S. Pat. No. 4,650,618.

FIELD OF THE INVENTION

The present invention relates to methods and apparatus for producing strip-like or foil-like products from metallic or metallic oxide material wherein a metallic or metallic oxide melt from a storage container is applied through a nozzle opening onto the surface of a cooler moved at a regulated speed.

BACKGROUND OF THE INVENTION

A method and an apparatus for producing amorphous metal strips are known (e.g., European Pat. No. 0,026,812), wherein a metallic melt from a storage container is forced from at least one nozzle opening and is solidified on the surface of a cooler moved past and in the immediate vicinity of the nozzle opening. When circular nozzles with a diameter of 0.5 to 1 mm are used for producing amorphous metal strips, there is an optimum relationship between the nozzle opening, the distance between the nozzle opening and the cooler surface, and the speed of the cooler surface. This permits the production of uniformly formed metal strips at high production speeds. Such strips can either be completely amorphous or have a two-phase amorphous/crystalline mixture. The term amorphous metal alloy means an alloy whose molecular structure is at least 50 percent, and preferably at least 80 percent amorphous.

Another method and apparatus for producing a metal strip are disclosed in German Pat. No. 2,746,238 where various nozzle shapes, which are complicated to manufacture, are used for the production of "wide" metal strips. The greatest strip width obtainable is 12 mm. Within the system a plurality of parallel, uniform nozzle jets must strike a moving substrate from a suitable distance, e.g., to obtain relatively wide strips. However, testing of this system has led to difficulties, particularly since the nozzle jets do not combine to form a pool and it is very difficult to obtain strips with a uniform cross-section. It is also difficult, if not impossible, to obtain a pool with an adequately uniform thickness for drawing strips wider than about 7.5 mm with an approximately uniform cross-section.

To overcome these difficulties, German Pat. No. 2,746,238 proposes devices with stepped nozzle shapes located very close to the cooler surface. The system permits production of strips with more uniform thickness, widths, and uniform strength characteristics, up to the range of the aforementioned widths.

In conjunction with an apparatus for producing metal strips at a high speed, a nozzle body with a curved surface and a slot-like nozzle opening is known for influencing the flow conditions between the nozzle body and the cooler surface (e.g., European Pat. No. 0,040,069). The strips produced in this way mainly have an amorphous structure. Although coating of the cooler surface with different materials is described, it is used exclusively to obtain specific physical surface properties, particularly completely satisfactory and easy detachment of the produced strips from the cooler surface.

Finally, British Pat. No. 2,083,455 discloses a drum-like cooler with a circumferential slot. The circumferential slot on the drum, to a certain extent, serves as a mold for a relatively thick metal strip which can be subsequently cut at right angles to form small disks, as are conventionally used in the manufacture of semiconductors.

The conventional methods and apparatus for producing strips of the aforementioned type suffer from an important disadvantage in that they cannot, in a practical manner, produce strips significantly wider than about 15 cm, despite a very considerable need for such strips. Heretofore, such strips could only be produced by complicated and cost-intensive rolling processes. Wider strips with an amorphous structure are needed, e.g., for the production of transformers. Such transformers have approximately 30% lower magnetic reversal losses than conventional stacks of sheets.

Further, known methods and apparatus for producing strips of the aforementioned type are used exclusively for producing strips with homogeneous structures. Conventional methods or apparatus are not used for producing strips having juxtaposed areas with different metallurgical structures, or different geometrical structures. There is a considerable need for such strips, e.g. for packaging foils, which heretofore had to be produced by the more complicated and cost-intensive rolling process, and for mass-produced products, particularly small parts, from strip or foil material, which heretofore had to be stamped or punched out of closed foils or strips. The stamping or punching process is also complicated and costly.

SUMMARY OF THE INVENTION

An object of the present invention is to provide a method and an apparatus for producing strip-like or foil-like products from metallic material or metallic oxide material with any random width and with separate areas of different structures (e.g., amorphous or crystalline).

Another object of the present invention is to provide a method and apparatus for producing strip-like or foil-like products with adjacent areas of different metallic and/or geometrical structures.

The foregoing objects are obtained by a method for producing strip-like and foil-like products from metallic material and metallic oxide material, comprising the steps of applying a material melt from a storage container through a plurality of juxtaposed nozzle openings onto a cooler surface, combining the melt from each nozzle opening into a closed melt upon contacting the cooler surface, solidifying the melt at the instant of combining, and moving the cooler surface at a regulated speed. The method produces a closed material layer of predetermined width.

The foregoing objects are also obtained by an apparatus for producing strip-like and foil-like products from metallic material or metallic oxide material, comprising a storage container, a cooler surface movable at a regulated speed, and a plurality of juxtaposed nozzle openings. The nozzle openings are coupled to the storage container and oriented relative to the cooler surface such that action ranges of the nozzle openings directly contact one another on the cooler surface.

The foregoing objects are further obtained by a method for producing strip-like or foil-like products from metallic material and metallic oxide material, comprising the steps of applying a material melt from a storage container through a nozzle opening onto a cooler surface and moving the cooler surface at a regulated speed. Solidification of the melt on the cooler surface is controlled by regulating conditions on the cooler surface such that different surface areas of the cooler surface have different conditions. After solidification of the melt, the solidified product is removed from the cooler surface.

The foregoing objects are additionally obtained by an apparatus for producing strip-like or foil-like products from metallic material or metallic oxide material, comprising a storage container, a nozzle opening coupled to the storage container and a cooler surface movable at a regulated speed. The cooler surface has a plurality of surface areas spaced along a perpendicular to the direction of cooler surface movement. The surface areas have different thermal conductivity characteristics.

The method and apparatus of the present invention overcome many of the previously experienced difficulties and the disadvantages associated with conventional systems. The present invention permits production of strips of almost any width and with separate areas of different structures (e.g. amorphous or crystalline), thereby facilitating a wide range of uses. For example, a foil can be produced having an amorphous structure in its central area, so that the central area is rigid and dimensionally stable or permeable or impermeable to air as required, while the edge areas have a soft and flexible crystalline structure permitting connection to other elements, e.g., by folding. The combined control of the method parameters for juxtaposed nozzles or nozzle groups permits determining, in an advantageous manner, the material characteristics of the strips to be produced.

Strips produced by this system can be used in a particularly advantageous manner for cladding or lining mechanically or chemically stressed parts, e.g. pipelines, to make them corrosion-proof, or to provide friction bearings. When using strips or foils produced according to the invention, such articles can be manufactured more simply and cheaply than when produced by traditional methods. In addition, the products produced according to the proposed system have better technological properties than conventionally produced products, e.g. by power-metallurgical methods.

According to a particular form of the invention, the cooler surface is segmented, perforated or profiled to define geometrically bounded areas. Such cooler surface can produce foils with a structured surface and with shape or form-limited individual areas. Thus, it is possible, in a simple and appropriate manner, to mass produce small parts from strip or foil material.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure:

FIG. 2 is a partial front elevational view of a first embodiment of a nozzle body with several individual slots, while

FIG. 3 is a front elevational view of a second embodiment with a slot nozzle formed from individual nozzles, while FIG. 3*a* is a sectional view taken along lines U—U of FIG. 3;

FIG. 4 is a side elevational view of a third embodiment with displaced individual nozzles and separate nozzle bodies;

FIG. 5 is a top view of the apparatus of FIG. 4;

FIG. 18*a* is an enlarged view of a portion of FIG. 18; and

DETAILED DESCRIPTION OF THE PREFERRED EMBODIMENTS

Figure 1:
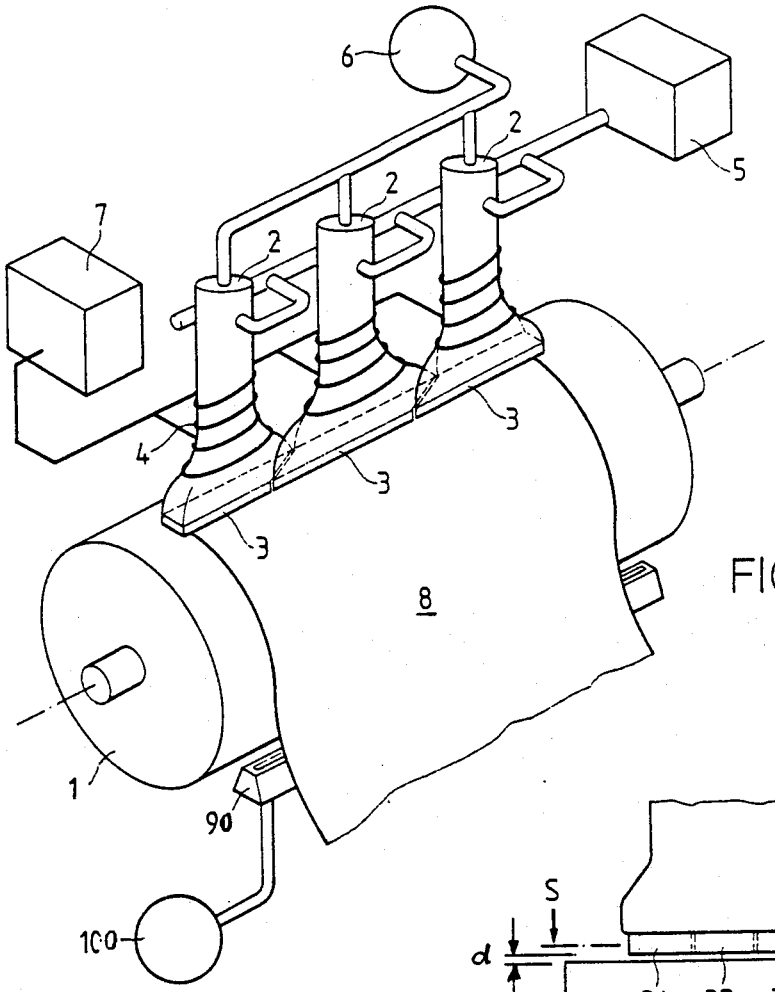
FIG. 1 is a diagrammatic perspective view of an apparatus according to the present invention.

The apparatus of the present invention, as diagrammatically illustrated in FIG. 1 comprises a movable cooler surface in the form of a continuously rotating drum 1, which drum acts as a cooler, storage containers 2 with one or more nozzles 3 (e.g. with one nozzle slot), and an induction heater 4 for heating the melt in the storage containers 2. Any other suitable temperature-stabilizing device can be used in place of the induction heater.

The storage containers 2 contain a molten metal, which is optionally supplied from a source 5. The storage containers 2 and the complete apparatus can be connected to an inert gas system, which is diagrammatically indicated in FIG. 1 by a gas container 6 connected to the storage containers 2. The area of the nozzle opening can also be surrounded by a protective gas atmosphere or be enclosed in a vacuum. To avoid possible unwanted influences of the boundry layer, the nozzle outlet can be covered with electrostatic fields. The storage containers 2 can be subjected to the action of a slight overpressure from gas container 6. Other devices for producing a pressure difference between a storage container and the nozzle openings can be used, e.g. known mechanical or electromagnetic pressure difference generating means. A regulated power supply means 7 is connected to induction heater 4. Source 5, power supply means 7 and heater 4 form control means for regulating storage container parameters. For the better detachment of the formed strip 8 from drum 1, a stripper nozzle 90 for air or protective gas connected to a reservoir 100 can be provided.

Figure 2:
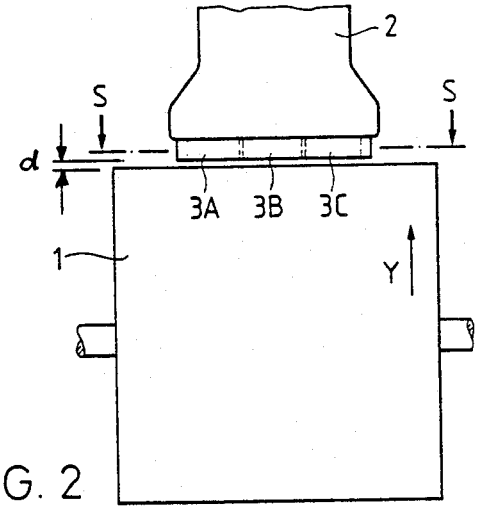
Figure 2A:
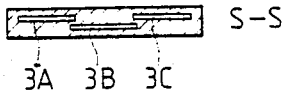
FIG. 2*a* is a sectional view taken along line S—S of FIG. 2.

In the illustrated embodiment of FIG. 1, the nozzle configuration 3 comprises a plurality of individual nozzles as described hereinafter. Essentially, a distinction is made between two construction types, which can be combined with one another. In a first construction type, as shown in FIG. 2, a single nozzle body integrated with the storage container 2 is provided which nozzle body has three individual slots 3A, 3B, 3C. In a second construction type, which is diagrammatically shown in FIGS. 3, 4 and 5, a plurality of nozzle bodies are provided having either individual nozzles 3 or nozzle groups 3A, 3B, 3C and being connected to separate storage containers 2A, 2B, 2C.

The slotted nozzle 3, comprising nozzle openings 3A, 3B, 3C according to FIGS. 2 and 3, extends at right angles to the movement direction Y of drum 1 and substantially parallel to the drum surface. Nozzle openings 3A, 3B, 3C are juxtaposed such that the molten metal flowing out of the storage container 2 or storage containers 2A, 2B, 2C forms a continuous, closed melt on the surface of drum 1 acting as a substrate. Drum 1, constructed as a cooler, produces a temperature drop in the melt coating causing immediate solidification of the melt and formation of a mechanically closed material web on the substrate. Through the selection of the melt temperature, e.g. with the aid of a regulatable power supply means 7, the selection of the movement speed of drum 1 and the selection of the temperature gradients on the substrate surface, it is possible to produce material webs having different structures, i.e. mainly an amorphous or a crystalline structure. Such crystal structures can be determined on the finished product, e.g. by X-ray diffraction measurements. Crystalline materials show characteristic sharp diffraction lines, while in amorphous material, the intensity of the X-ray diffraction pattern only changes slowly with the diffraction angle.

When using separate nozzle bodies connected to separate storage containers 2A and 2B, it is possible to produce material webs, which contain in juxtaposed manner an amorphous/amorphous or amorphous/crystalline structure. A foil produced in this way appears as a closed or mechanically unitary web, but in different areas has the known varying characteristics for crystalline or amorphous structure. For example, a foil produced in this way, is highly elastic and stable in the central area, and is soft and consequently easily deformable in the edge areas, so that it is eminently suited as a packaging foil. A more exacting field of use involves the production of juxtaposed and interconnected printed conductors with normal and superconducting regions on a foil. Such foils can be used in the production of high-field coils for fusion plants.

According to the embodiment shown in FIGS. 4 and 5, the nozzle heads and their separate storage containers 2A, 2B, 2C are displaced from one another in the movement direction Y of drum 1. Thus, the action areas of the nozzles or nozzle groups belonging to the individual storage containers follow one another in jointless manner at right angles to the movement direction Y of drum 1. This arrangement permits the production of different material webs which directly link regions of different material. The transitions between the regions are along sharp dividing lines. This is achieved by controlling the method parameters, the melt temperature, the spacing between the nozzles and the movement speed of the drum surface, such that a second melt, with a different composition and provided from the second storage container 2B, is directly melted on the already solidified melt from storage container 2A. This forms a unitary material layer, which can be removed as a single entity from the drum surface.

Figure 6:
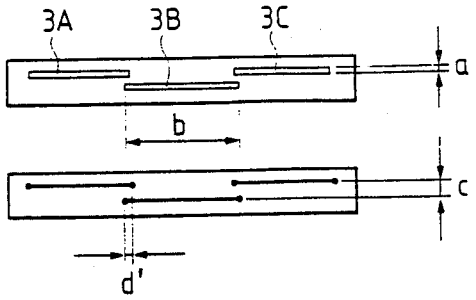
FIGS. 6A and 6B are bottom plan views of a nozzle body with displaced nozzle slots.

In order to obtain optimum connection regions between the nozzle openings 3A, 3B, 3C, it is particularly advantageous to reciprocally displace juxtaposed nozzle openings in movement direction Y (see FIGS. 6A and 6B). Such nozzle modules 8A, 8B, 8C can be used individually or positively juxtaposed in plural form on the bottom of a storage container 2. Such nozzle module contains several nozzle openings 3A, 3B, 3C with a slot width a, a slot length b, a displacement c and an overlap d'. This arrangement leads to particularly advantageous, uniform covering of the action areas of the nozzle openings. The following values have proved to be particularly advantageous: $a=0.3$ to 0.6 mm, $b=20$ to 100 mm, $c=0$ to 5 mm and $d'=0$ to 3 mm.

Figure 7:
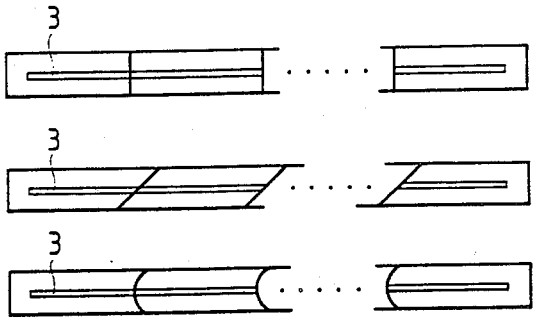
FIGS. 7A to 7C are bottom plan views of nozzle modules with a through nozzle slot.
Figure 8:
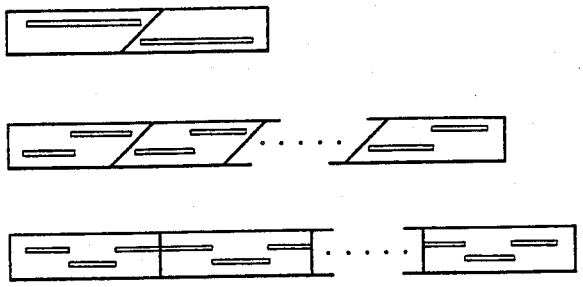
FIGS. 8A to 8C are bottom plan views of nozzle modules with displaced nozzle slots.
Figure 9:
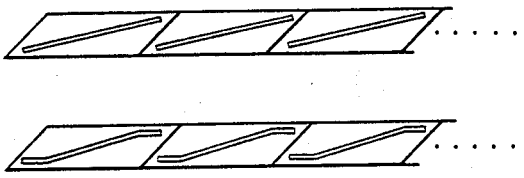
FIGS. 9A and 9B are bottom plan views of nozzle modules with sloping nozzle slots.

FIGS. 7 to 9 show further advantageous embodiments of such nozzle modules. According to Figs. 7A to 7C, the juxtaposed nozzle modules have a through or continuous nozzle slot 3. According to FIG. 7A, the abutting surfaces between the modules are at right angles to the nozzle slot. FIG. 7B shows sloping abutting surfaces, which in practice leads to particularly good transitions between the individual nozzle modules, and which makes it virtually impossible to detect interfaces on the product produced. According to FIG. 7C, there are curved abutting surfaces between the modules, which particularly advantageously permit a self-centering mechanism for the through nozzle slot.

Each of the nozzle modules according to FIG. 8A contains a nozzle opening and sloping abutting surfaces. According to FIG. 8B, each module contains several, and in the specific embodiment, two displaced nozzle openings and sloping abutting surfaces between the modules. The nozzle openings are also displaced at the interfaces However, the nozzle openings of FIG. 8C are continuous over the abutting surfaces which are at right angles to the nozzle slots.

FIGS. 9A and 9B show embodiments in which juxtaposed sloping nozzle openings overlap one another in such that the bent or extended ends of these openings overlap the adjacent nozzle module. In this manner, no special starting and finishing modules are required.

According to a preferred embodiment for producing an amorphous strip from the alloy $Fe_{40}Ni_{40}B_{20}$, an apparatus according to FIGS. 1 and 2 was used in which a multiple nozzle arrangement had an overlap d' of 1 mm, a displacement C of 3 mm, a nozzle slot width of 3 mm and a distance d between the nozzles and the substrate surface of 0.3 mm. A casting speed of 1.2 km/min was obtained from a drum rotation speed of 1200 r.p.m. and a drum diameter of 30 cm.

According to a further embodiment in which a modular nozzle according to FIG. 7 was used, the size of the individual nozzle was $2.0\times0.3\times35$ mm, with the distance d between the nozzle and the substrate surface being 0.3 mm. The casting speed was the same as in the previous embodiment.

It has proved advantageous to select the distance d between the nozzles and the substrate surface so that it is larger than the thickness of the strip or layer to be produced, and is smaller than 0.5 mm. In order to produce amorphous strips or layers, a casting speed in the range 1.2 to 2.0 km/min has proved to be particularly advantageous for the aforementioned preferred embodiments. In the embodiment, strips with a width of 5 to 30 cm were produced.

By means of the described methods and apparatus, it is possible to produce in a particularly advantageous manner foils from, e.g. with Ni and Pd for catalytic reactions, Cu-Ti, Cu-Zr, Ni-Zr, and Mg-Nn alloys, e.g. for hydrogen reservoirs, as well as soldering foils based on iron for welding stainless steel and nickel alloys and for joining ceramics with metal parts. It is also possible to produce transformer plates or Ge-containing or Si-containing alloys for semiconductor purposes, or carrier material, e.g. silicon solar cells can be coated therewith. It is also possible to produce superconducting alloys in this way. According to the described system, high-quality foils can be held on the edges of less valuable transport materials permitting the mechanical working of such foils with the aid of transport means acting on the edge, while protecting the useful foil.

Using such products or the described method, it is possible to produce composite materials of the most varied types, e.g. different metal alloys in sandwich form, or with the isostatic moulding of fibrous materials, strips and the like. Using the foils or strips produced by the method and apparatus according to the invention, it is also possible to clad or line pipes or transport lines so that they have a corrosion resistant surface of high-quality material, while the carrier material can be a simple, inexpensive mass-produced product.

Large-area coatings of this type can be achieved by several abutting material webs. The abutting regions between the juxtaposed material webs are subsequently treated in a subsequent operation such that a homogeneous surface of uniform thickness is obtained. The additional step can, for example, be performed with the aid of laser glassing. The material coatings in the abutting regions are briefly and locally melted to an adjustable penetration depth. The cooling potential of the surrounding material is sufficient to permit the solidification, in glass-like manner, of the melted-on volume with very high cooling rates, e.g. in the range of $10^4$ and $10^5$ °C./sec so that once again an amorphous material structure can be produced. By means of this method, it is possible to upgrade the surfaces of pipes or shafts. Workpieces with relatively large dimensions can also be provided with age-hardened or hardened surfaces.

Figure 10:
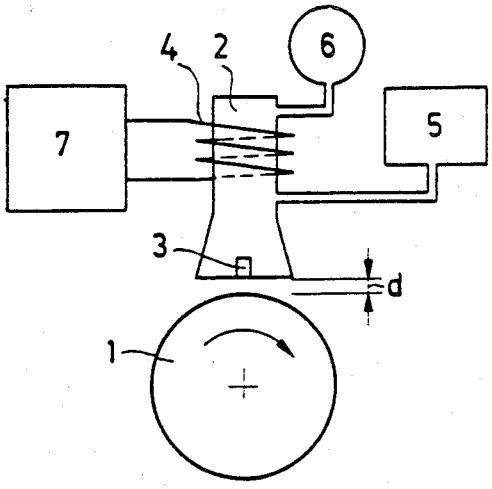
FIG. 10 is a side elevational view of an apparatus according to the present invention.

The apparatus shown in FIG. 10 comprises a continuously rotating drum 1 acting as a cooler, a storage container 2 with at least one nozzle opening 3 and an inductive heater 4 for heating the melt in storage container 2. Nozzle opening 3 is at a distance d from the surface of drum 1. Storage container 2 contains a molten metal, or a metal alloy or metallic oxide, which is optionally supplied from a source 5. Both the storage container 2 and the complete apparatus can be operated as a pressure or inert gas system, which is diagrammatically indicated in FIG. 1 by a pressure container 6 connected to storage container 2. A regulated power supply means 7 is connected to the induction heater 4. The melt flowing from storage container 2 forms a thin melt coating on the surface of drum 1 acting as a substrate.

Figure 11:
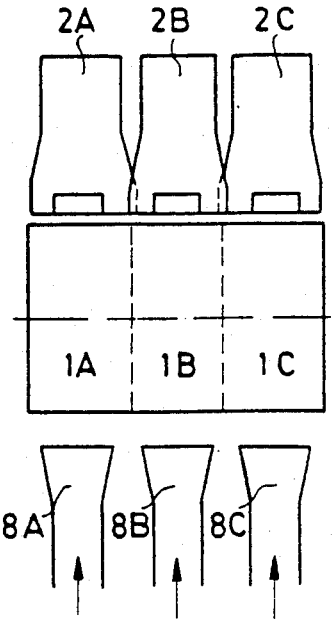
FIG. 11 is a front elevation view of a preferred embodiment with several storage containers, for producing a strip or foil with juxtaposed areas of different materials or qualities.

When using separate storage containers 2A, 2B, 2C according to FIG. 11, individual storage containers 2A, 2B, 2C can contain different metals or alloys which solidify to a unitary strip on drum 1.

According to the embodiment of FIG. 11, three cooling means 8A, 8B, 8C supply the drum 1 in areas 1A, 1B and 1C with a fluid coolant, e.g., air or inert gas. By the selection of suitable cooling capacities with the aid of cooling means 8A, 8B and 8C, it is possible to produce different temperature ranges on the drum surface in areas 1A, 1B and 1C. The melts flowing out of storage containers 2A, 2B and 2C are therefore quenched to a varying degree on striking the drum surface so that a desired crystal structure can be obtained on any one of the drum areas 1A, 1B and 1C within the resulting closed material web.

The aforementioned system also makes it possible to produce a closed or unitary material web from juxtaposed areas of different materials. The corresponding melts of the desired materials fill storage containers 2A, 2B, 2C and coat the drum surface forming a joint-free closed web with juxtaposed areas of different material. The cooling conditions on the drum surface are set by cooling means 8A, 8B, 8C using known criteria. In this manner, the solidifcation conditions on the drum surface are adapted to the selected removal rate, i.e. to the rotation speed of the drum.

Figure 12:
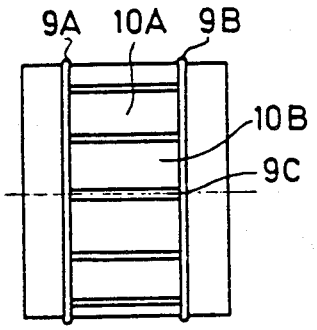
FIG. 12 is a plan view of a cooling drum with a segmented surface structure.
Figure 13:
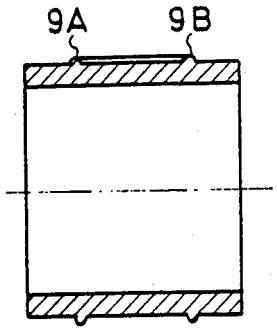
FIG. 13 is a sectional view of the drum according to FIG. 12.

According to FIGS. 12 and 13, the drum surface is provided with separating ribs 9A, 9B, 9C which separate intermediate substrate regions 10A, 10B. Foil segments formed in substrate regions 10A, 10B are only slightly separated from one another in the vicinity of the separating ribs 9A, 9B, 9C, so that the resulting strip-like material can be removed from the drum 1 as an entity and the segments can be easily separated from one another in a subsequent processing stage, e.g. during the final working of the foils.

Figure 14:
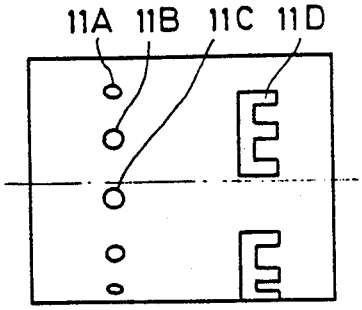
FIG. 14 is a plan view of a cooling drum with a perforated surface structure.
Figure 15:
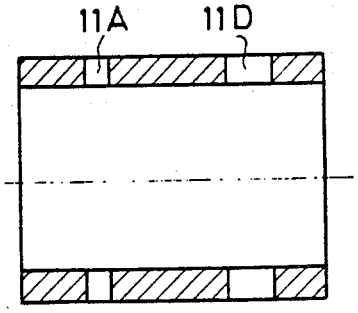
FIG. 15 is a sectional view of the drum according to FIG. 14.

According to the embodiment shown in FIGS. 14 and 15, perforations 11A, 11B, 11C and 11D are provided in the drum and can have random configurations. The perforated regions on the drum surface are not wetted by the applied melt so that there are corresponding recesses in the resulting strip-like material. This obviates the conventional additional process stages, such as stamping or punching. Thus, a high degree of further processability is achieved directly at the time of the production of the foils or strips. Alternatively, projecting areas, instead of recesses, can be formed on the drum surface so that the resulting strip-like material has a corresponding shape.

The embodiment according to FIGS. 14 and 15 also makes it possible to combine different materials or material characteristics in juxtaposed areas.

Figure 16:
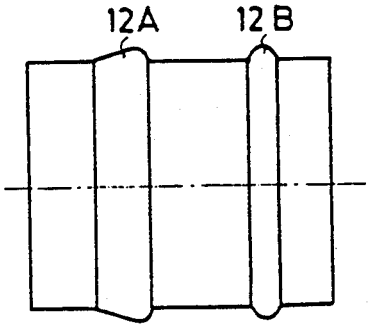
FIG. 16 is a plan view of a cooling drum with a profiled surface.
Figure 17:
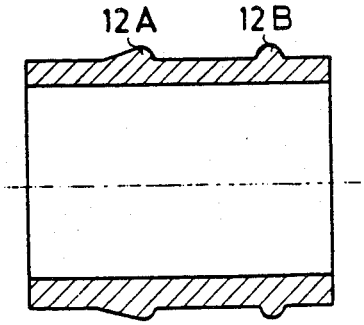
FIG. 17 is a sectional view of the drum according to FIG. 16.

In the embodiment shown in FIGS. 16 and 17, the cooling drum surface has profiles 12A, 12B, e.g. rib profiles. These ribs, unlike the embodiment of FIGS. 12 and 13, have smooth transitions so that the ribs are uniformly coated by the melt and a corresponding foil-like or strip-like material forms. Such a material is used as a top-quality semifinished product, e.g. in the production of catalyst foils in chemical engineering.

Figures 18, 19:
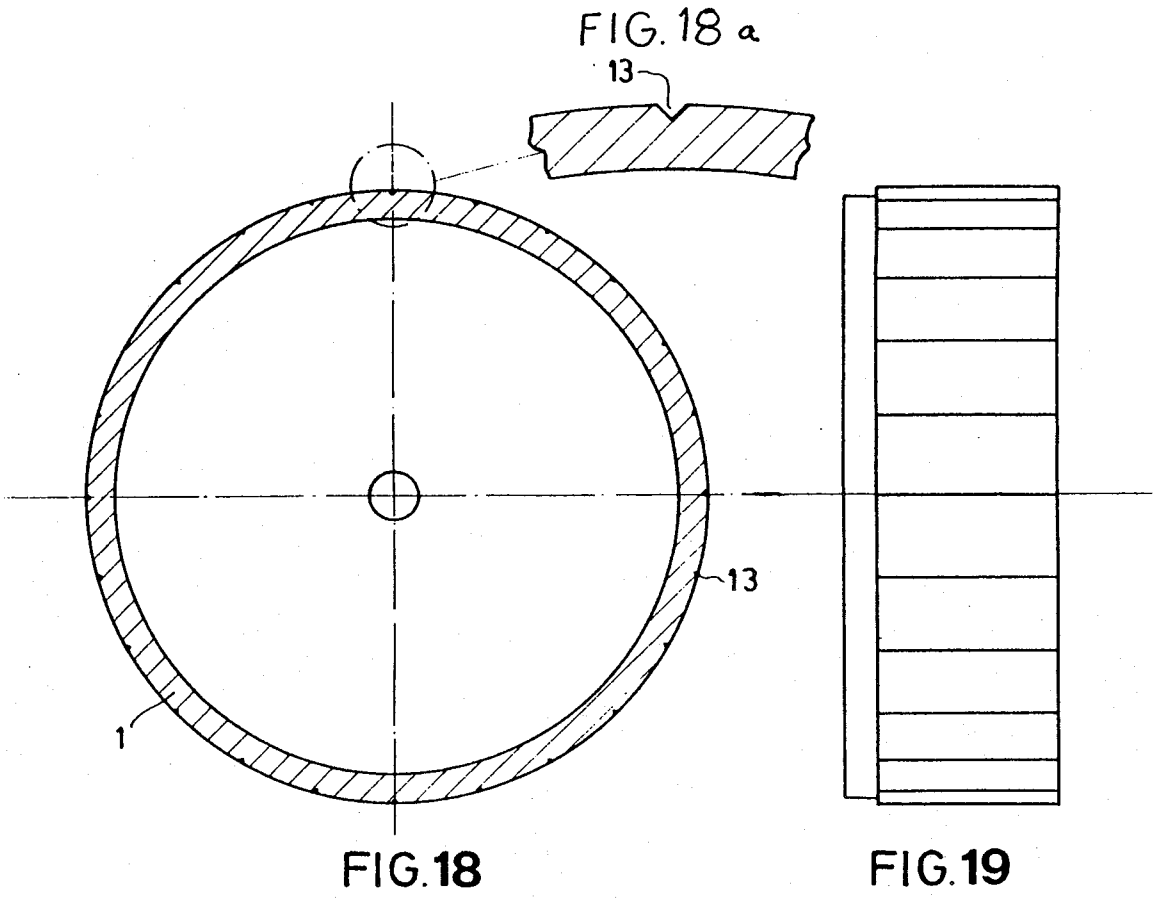
FIG. 18 is a sectional view of another embodiment of the cooling drum.
FIG. 19 is a plan view of the embodiment according to FIG. 18.

In embodiments according to FIGS. 18 and 19, the drum 1 has uniformly spaced transverse grooves 13. When using a fine nozzle opening 3, the grooves will produce material fibers whose length corresponds to the spacing between the transverse grooves. In the present embodiment, drum 1 has a diameter of 280 mm. The fiber length of 2 cm was obtained by segmenting the drum in 2 cm spacings. The V-shaped transverse groove 13 has a depth of 1 mm and an angle of 60°. The drum rotation speed is 1500 r.p.m., corresponding to a casting speed of 1.32 km/min. The nozzle used has a 0.5 mm diameter hole, while the distance d between the nozzle opening and the drum was approximately 2 mm. The embodiment was carried out with a $Fe_{40}Ni_{40}B_{20}$ alloy. Typical fiber dimensions are width 0.5 mm, length 20 mm and thickness 30 μm.

Such short fibers made from metallic glasses can be used for reinforcing plastics, ceramics or cement. They also form a starting material for molding and sintering in the production of compact, glass-like or finely crystalline workpieces.

In a modified embodiment, the nozzle opening 3 can be in the form of a slot to produce wide foil pieces. A slot nozzle with a width of 20 mm was used. The distance d was approximately 0.3 mm. The alloy used was $Fe_{40}Ni_{40}B_{20}$. The dimensions of a foil piece were width 20 mm, length 20 mm and thickness 60 μm.

According to another embodiment for producing profiled strips or strip portions according to FIGS. 16 and 17, the drum 1 had a diameter of approximately 320 mm. The drum surface was provided with a slightly rounded longitudinal profile of width 1.5 mm and a projection of 0.2 mm. The speed of revolution was 1500 r.p.m.

The nozzle used had a nozzle opening width of 9 mm. The distance between the nozzle opening and the profile surface was 0.3 mm. Typical values for the dimensions of the strip with profiled cross-section were, according to FIG. 11, width 9 mm, thickness at the ends 45 μm and thickness in the center 35 μm.

According to another embodiment, the previously produced foils and other semifinished products were coated several times using the aforementioned method. A semifinished product was obtained with several coatings of different materials or different crystal structures. For example, the drum 1, serving as a cooler, and which constituted the substrate for the strips or coating to be produced, was replaced by a suitable semifinished product, e.g. a pipe or other workpiece. The semifinished product can be coated with the aid of the described apparatus and method. While maintaining a continuous drawing speed, the semifinished product to be coated is moved under the nozzle body and cooled as a function of the material properties or thermal conductivity characteristics of the semifinished product used as the substrate. The coating with the desired crystal structure (crystalline or amorphous) is formed on the surface. Pipes with an amorphous coating produced in this way have a particularly high degree of corrosion resistance with the appropriate choice of coating material. They can be used with particular advantage in the manufacture of chemical apparatus. They are much less expensive then conventional solid material pipes for this purpose, because simple, inexpensive material can be used as the semifinished product.

While various embodiments have been chosen to illustrate the invention, it will be understood by those skilled in the art that various changes and modifications can be made therein without departing from the scope of the invention as defined in the appended claims.

What is claimed is:

1. An apparatus for forming strip-like or foil-like products from metallic material or metallic oxide material, comprising:

at least one storage container means for supplying metallic or metallic oxide melt;

a cooler surface movable at a regulated speed; and a plurality of laterally juxtaposed and overlapping nozzle openings coupled to said storage container means and oriented relative to said cooler surface such that action ranges of said nozzle openings overlap one another on the cooler surface, and such that melts from said nozzle openings combine into a closed melt upon contacting said cooler surface, which closed melt is solidified upon combining of the melt from each of said nozzle openings producing a product of uniform metallurgical quality over an entire width thereof, the width being greater than that of each of said nozzle openings.

2. An apparatus according to claim 1 wherein said nozzle openings are spaced relative to one another in the direction of movement of the cooler surface; and said cooler surface forms a substrate.

3. An apparatus according to claim 1 wherein a nozzle slot is formed by a plurality of juxtaposed nozzle bodies, each of said nozzle bodies having at least one nozzle opening.

4. An apparatus according to claim 3, wherein each of said nozzle bodies has a plurality of nozzle openings.

5. An apparatus according to claim 1 wherein a nozzle slot is formed by a plurality of positively joined nozzle modules.

6. An apparatus according to claim 2 wherein a nozzle slot is formed by an uneven number of nozzle openings with the two laterally outermost nozzle openings aligned relative the direction of the cooler surface movement.

7. An apparatus according to claim 1 wherein a plurality of storage containers are regulated by control means for regulating storage container parameters.

8. An apparatus according to claim 6 wherein each of said nozzle openings has a first end on a first line extending perpendicularly to the direction of cooler surface movement and a second end on a second line extending perpendicularly to the direction of cooler surface movement and spaced from said first line in the direction of cooler surface movement.

9. An apparatus according to claim 1 wherein said nozzle openings are connected to different storage containers containing different melts, said nozzle openings for different melts being spaced relative to one another in the direction of cooler surface movement and from said cooler surface such that said action areas overlap on said cooler surface in a direction perpendicular to cooler surface movement.

10. An apparatus according to claim 1 wherein said nozzle openings define slot width between about 0.3 mm and about 0.8 mm, and a slot length between about 20 mm and about 100 mm.

11. An apparatus according to claim 1 wherein said nozzle openings are spaced relative to one another in the direction of cooler surface movement by a maximum distance of 5 mm.

12. An apparatus according to claim 1 wherein said nozzle openings are spaced relative to one another in the direction of cooler surface movement by a distance between about 5 mm and about 12 mm.

13. An apparatus according to claim 1 wherein said cooler surface comprises a plurality of surface areas spaced along a direction perpendicular to the direction of a cooler surface movement, said surface areas having different thermal conductivity characteristics.

14. An apparatus according to claim 1 wherein said cooler surface comprises a rotating drum.

15. An apparatus for forming strip-like or foil-like products from metallic material or metallic oxide material, comprising:

at least one storage container means for supplying metallic or metallic oxide melt;

at least one nozzle opening coupled to said storage container; and a cooler surface movable at a regulated speed, said cooler surface having a plurality of surface areas spaced along a direction perpendicular to the direction of a cooler surface movement, said surface areas having different thermal conductivity characteristics.

16. An apparatus according to claim 15 wherein each of said surface areas are coupled to a common cooling circuit comprising a fluid cooling medium.

17. An apparatus according to claim 15 wherein the cooler surface is profiled.

18. An apparatus according to claim 15 wherein a plurality of laterally juxtaposed and overlapping nozzle openings are coupled to said storage container means which combine melts therefrom for solidification.

* * * * *